US006769367B2

(12) United States Patent
Schütz

(10) Patent No.: US 6,769,367 B2
(45) Date of Patent: Aug. 3, 2004

(54) PALLET WITH A BASE PLATE AND LEGS OF METAL

(75) Inventor: Udo Schütz, Selters (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 10/074,206

(22) Filed: Feb. 12, 2002

(65) Prior Publication Data

US 2002/0069795 A1 Jun. 13, 2002

Related U.S. Application Data

(62) Division of application No. 09/638,092, filed on Aug. 11, 2000, now abandoned.

(51) Int. Cl.[7] ..... B65D 19/00
(52) U.S. Cl. ..... 108/51.11; 108/57.3
(58) Field of Search ..... 108/51.11, 57.2, 108/57.3, 57.32, 55.1, 55.3; 29/527.1

(56) References Cited

U.S. PATENT DOCUMENTS 1,741,189 A * 12/1929 Jencks
1,812,218 A * 6/1931 Powell
2,123,714 A * 7/1938 Clark
2,256,750 A * 9/1941 Riemenschneider
2,463,214 A * 3/1949 Stoner
2,936,986 A * 5/1960 Joohnson
3,776,146 A * 12/1973 Morrison
3,882,796 A * 5/1975 Andreini et al.
4,145,974 A * 3/1979 Fleming et al.
4,326,467 A * 4/1982 Schleicher et al.
4,424,752 A * 1/1984 Aberg
5,367,960 A * 11/1994 Schleicher

* cited by examiner

*Primary Examiner*—Jose V. Chen
(74) *Attorney, Agent, or Firm*—Friedrich Kueffner

(57) ABSTRACT

A pallet includes a base plate of cantilever construction and legs of metal, particularly as an underframe for pallet containers for transporting and for storing liquids in an inner container of synthetic material standing on the base plate of the pallet, and an outer casing composed of a grid structure or sheet metal material attached to the base plate. The base plate and the legs of the pallet are manufactured as a single piece from a sheet metal plate as the initial material by deformation, particularly by deep-drawing and/or pressing or by hydroforming.

1 Claim, 5 Drawing Sheets

PALLET WITH A BASE PLATE AND LEGS OF METAL

This application is a divisional of U.S. application Ser. No. 09/638,092, filed Aug. 11, 2000 now abandoned.

BACKGROUND OF THE INVENTION

1. Field of the Invention

The present invention relates to a pallet with a base plate and legs of metal, particularly as an underframe for pallet containers for transporting and for storing liquids in an inner container of synthetic material standing on the base plate of the pallet, and with an outer casing composed of a grid structure or sheet metal material attached to the base plate.

2. Description of the Related Art

In the past, metal pallets were manufactured as welded metal section or metal pipe constructions or of deep-drawn components and metal sections. As a rule, the welded metal constructions have a high weight and are very difficult and complicated to manufacture. The lightweight constructions of deep-drawn components usually have a low structural strength and they are difficult to stack and to transport. In most lightweight constructions of deep-drawn components, the pallet legs are formed by cup-shaped deep-drawn components which are closed towards the outer side of the pallet. The strength of the pallet is ensured primarily by a closed basic pallet construction to which the pallet legs are welded. The connections of the pallet legs to the base plate of the pallet and to the outer casing of a grid structure or sheet metal material in a pallet container equipped with an inner container of synthetic material are usually screw connections. This type of construction does not make it possible to provide, or makes it difficult to provide, pallets of metal with skid rails because the pallet legs are not constructed as structural supporting members. It is technically very difficult to provide an improved connection of the pallet legs to the base plate. In addition, assembled pallets are difficult to stack and transport because they cannot be nested. Finally, a weight-saving basic pallet construction of synthetic material or wood has in the past not been manufactured for pallet containers because of the insufficient inherent stability of the pallet legs.

SUMMARY OF THE INVENTION

Therefore, it is the primary object of the present invention to develop a metal pallet which has a high stability while having a low weight, and which can be stacked in an optimum manner and makes it possible to manufacture a wide variety of types of basic pallet constructions.

In accordance with the present invention, the base plate of cantilever construction and the legs of the pallet are manufactured as a single piece from a sheet metal plate as the initial material by deformation, particularly by deep-drawing and/or pressing or by hydroforming.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
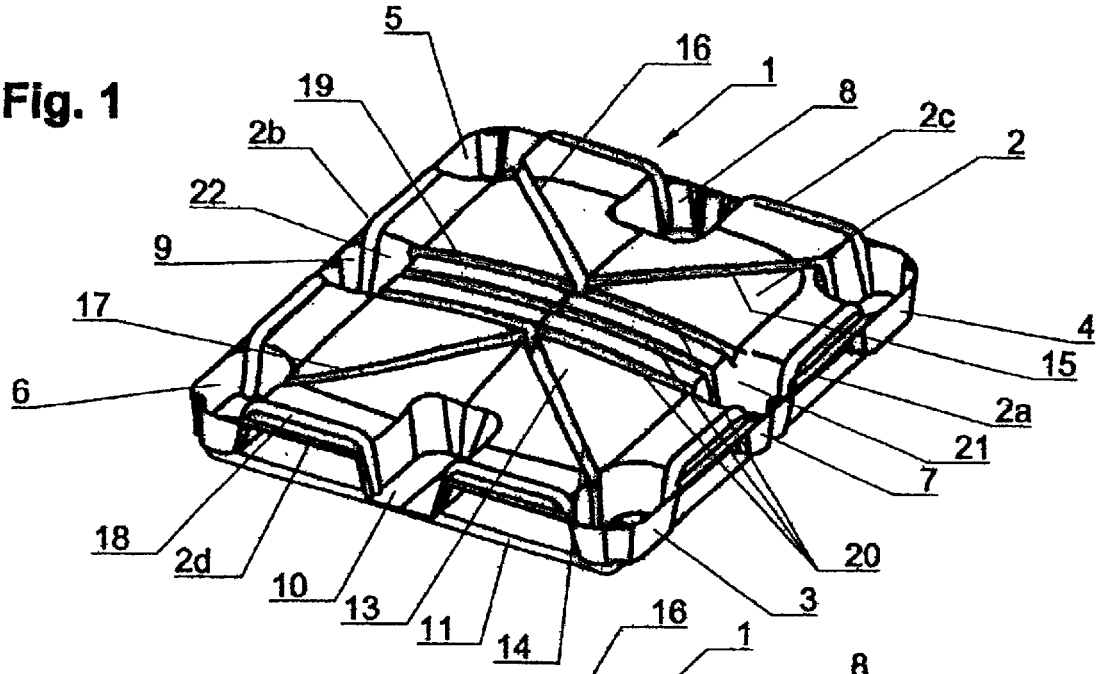
FIG. 1 is a perspective view of a pallet with partially open legs and a base frame.

The principal components of the pallet 1 according to FIG. 1 are an upwardly arched base plate 2, four corner legs 3 to 6 and four middle legs 7 to 10 of sheet steel and a base frame 11 made of steel pipe and attached to the corner legs and middle legs 3 to 10.

Figure 2:
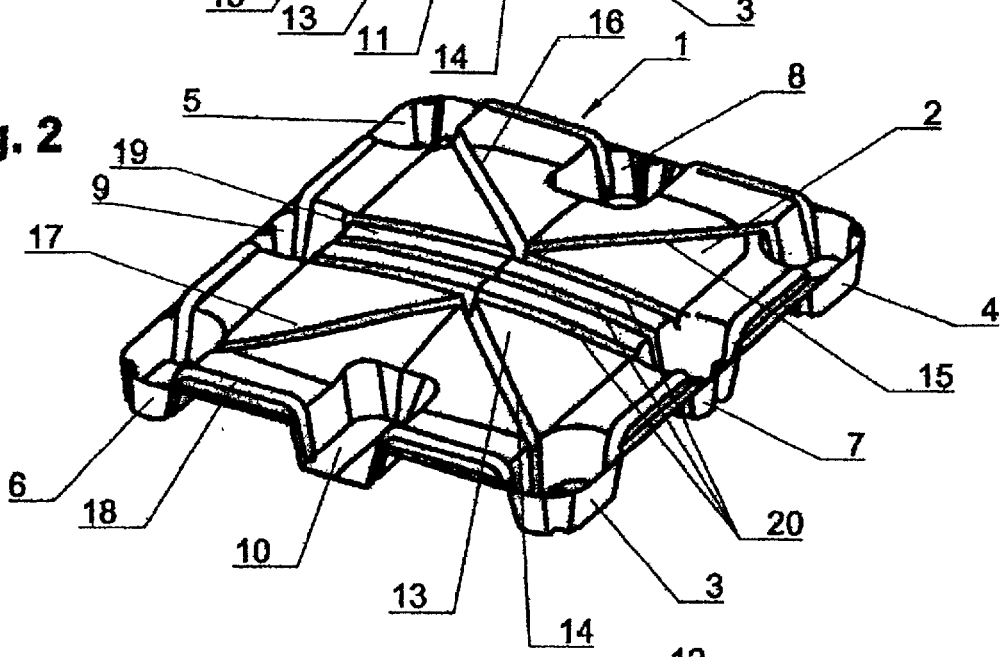
FIG. 2 is a perspective view, corresponding to FIG. 1, showing the pallet without base frame.
Figure 3:
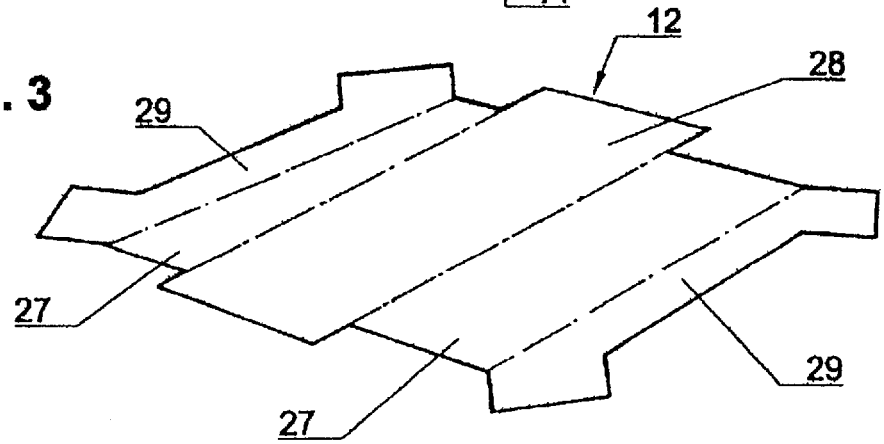
FIG. 3 is a perspective view of a sheet metal plate used for manufacturing the pallet according to FIGS. 1 and 2.

The base plate 2 of cantilever construction as well as the four corner legs 3 to 6 and the four middle legs 7 to 10 of the pallet 1, with base frame 11 according to FIG. 1 and without base frame according to FIG. 2, are deep-drawn as a single piece from a sheet metal plate 12 shown in FIG. 3, wherein the cup-shaped four corner legs 3 to 6 and the three middle legs 7 to 9 at the two longitudinal sides 2*a*, 2*b* and the rear side 2*c* of the base plate 2 are closed to the side and bottom and are open towards the top. The middle leg 10 at the front side 2*d* of the base plate 2 is open towards the top and towards the front.

The base plate 2 has four stiffening ribs 14 extending from the corner legs 3 to 6 towards the central plate portion 13 and an additional edge stiffening rib 18 which extends along the two longitudinal sides 2*a*, 2*b*, the rear side 2*c* and the front side 2*d* of the base plate 2 and completely or partially through the corner and middle legs 3 to 10.

The base plate 2 of the pallets 1 according to FIGS. 1 and 2 additionally has a bridge-like stiffening portion 19 formed of parallel stiffening ribs 20 in the base plate 2, wherein the stiffening ribs 20 extend from the middle section 21 of the longitudinal side 2*a* through the central plate portion 13 to the middle section 22 of the oppositely located longitudinal side 2*b* of the base plate 2, and wherein the middle legs 7, 9 are integrated in the bridge-like stiffening portion 19.

Figure 4:
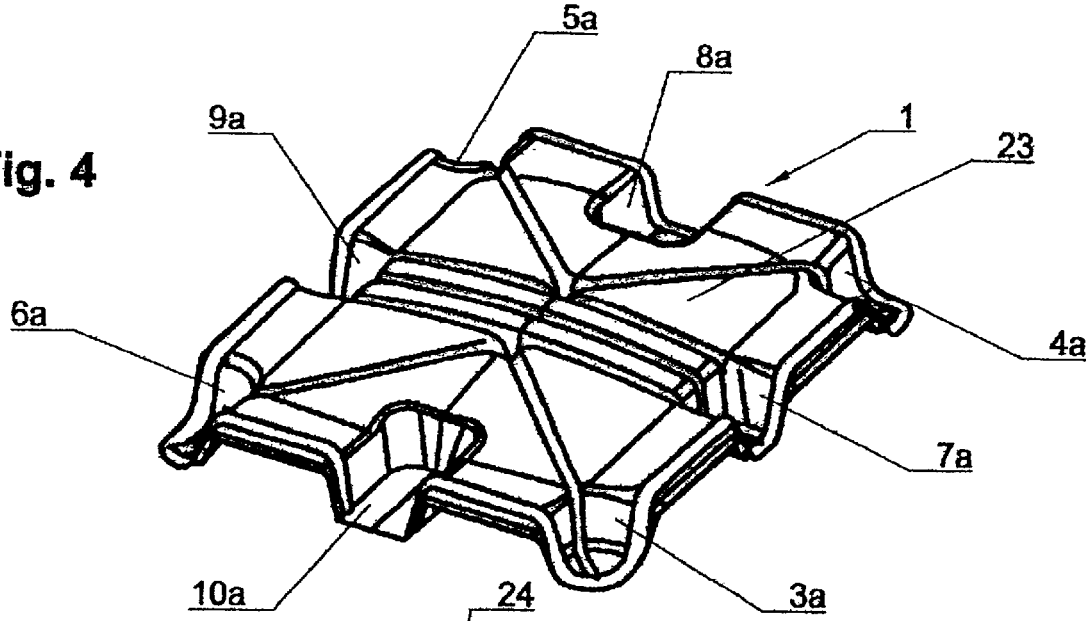
FIG. 4 is a perspective view of a base plate with open legs for a pallet.
Figure 5:
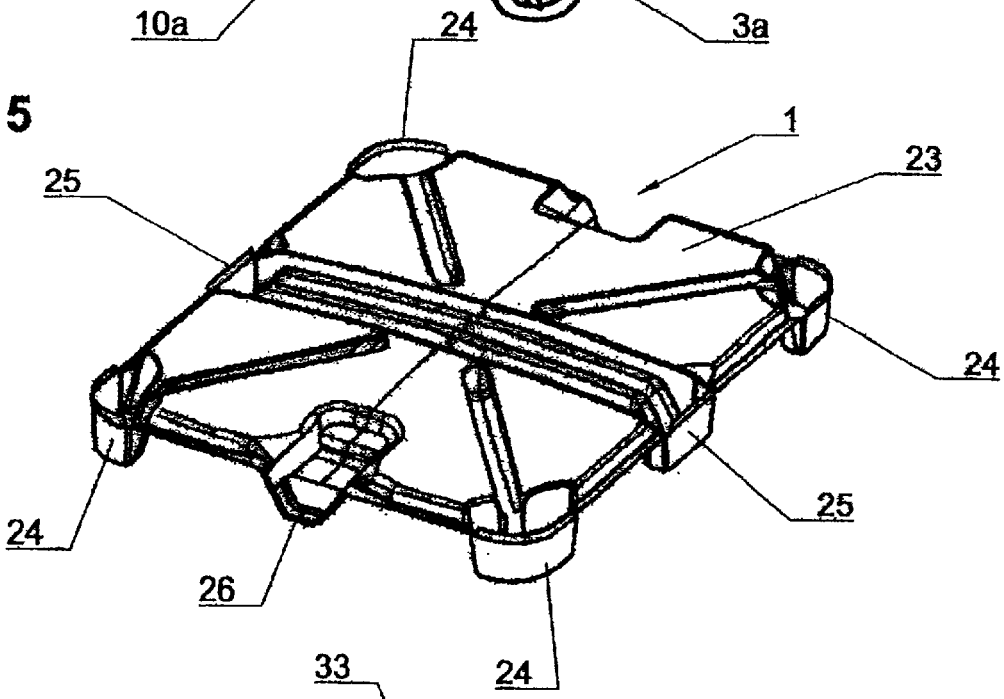
FIG. 5 is a perspective view of a base plate of FIG. 4 whose legs are covered with cover plates.

The base plate 23 according to FIG. 4 which is deep-drawn from a sheet metal plate 12 has open corner legs and middle legs 3*a*–6*a*, 7*a*–10*a* which, as illustrated in FIG. 5, are covered by cover plates 24 to 26.

The flat sheet metal plate 12 according to FIG. 3 which is used for deep-drawing the base plate 2 and the legs 3 to 10 for the pallets 1 according to FIGS. 1 and 2 as a single piece has different plate sections 27 to 29 with different thicknesses for obtaining different strength values and to adjust to the different load zones of the base plate 2.

This optimization of the sheet metal structures, which is also known under the term tailored blanking, is carried out in order to achieve a cost-saving production of the structural components while simultaneously improving the product. Sheet metal plates 12 with different thickness sections for manufacturing base plates 2 with legs 3 to 10 are produced by flexible rolling in which the adjustment of the roll gap during the rolling process is controlled in accordance with the desired plate thicknesses.

Figure 6:
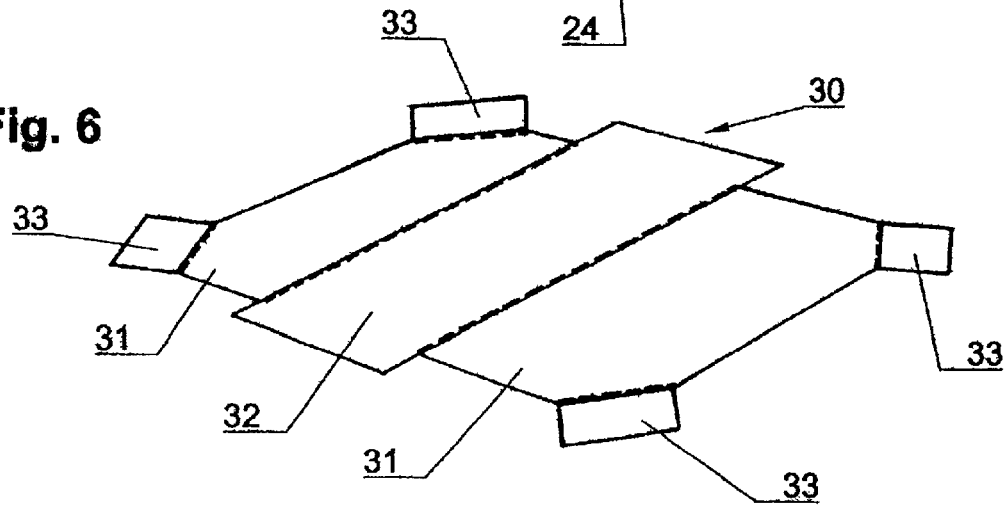
FIGS. 6 to 8 are perspective views showing different embodiments of sheet metal plates for manufacturing base plates with legs for pallets.

Moreover, for manufacturing base plates 2 with legs 3 to 10 it is also possible to use sheet metal plates 30 in accordance with FIG. 6 which are composed of welded-together sheet metal sections 31 to 33 with different thicknesses in accordance with the different load zones of the base plates 2.

The sheet metal plates 30 can also be composed of welded-together sheet metal sections 31 to 33 having different material compositions depending on the different load zones of the base plates 2.

Figure 7:
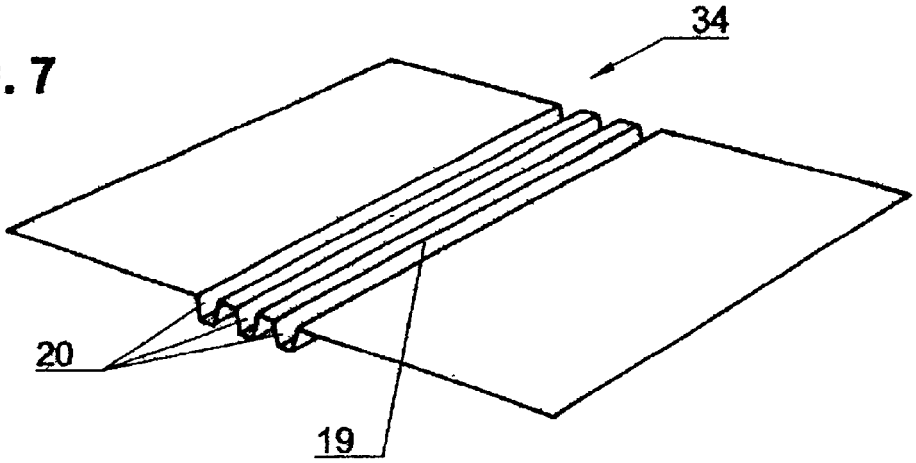

The sheet metal plate 34 according to FIG. 7 used for the single-piece manufacture of base plates 2 with legs 3 to 10 as shown in FIGS. 1 and 2 is provided with pre-shaped stiffening ribs 20 of the bridge-like stiffening portion 19.

Figure 8:
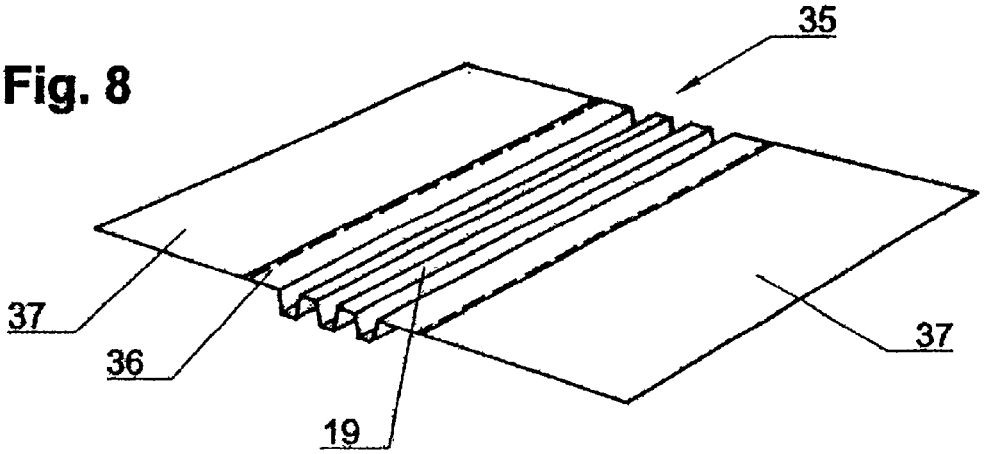

The sheet metal plate 35 according to FIG. 8 for manufacturing base plates 2 with legs 3 to 10 is composed of a sheet metal section 36 with the preshaped stiffening ribs 20 of the stiffening portion 19 and two flat sheet metal sections 37 which are welded together.

Without the base frame 11, the pallets 1 according to FIG. 2 can be stacked in each other.

Figure 9:
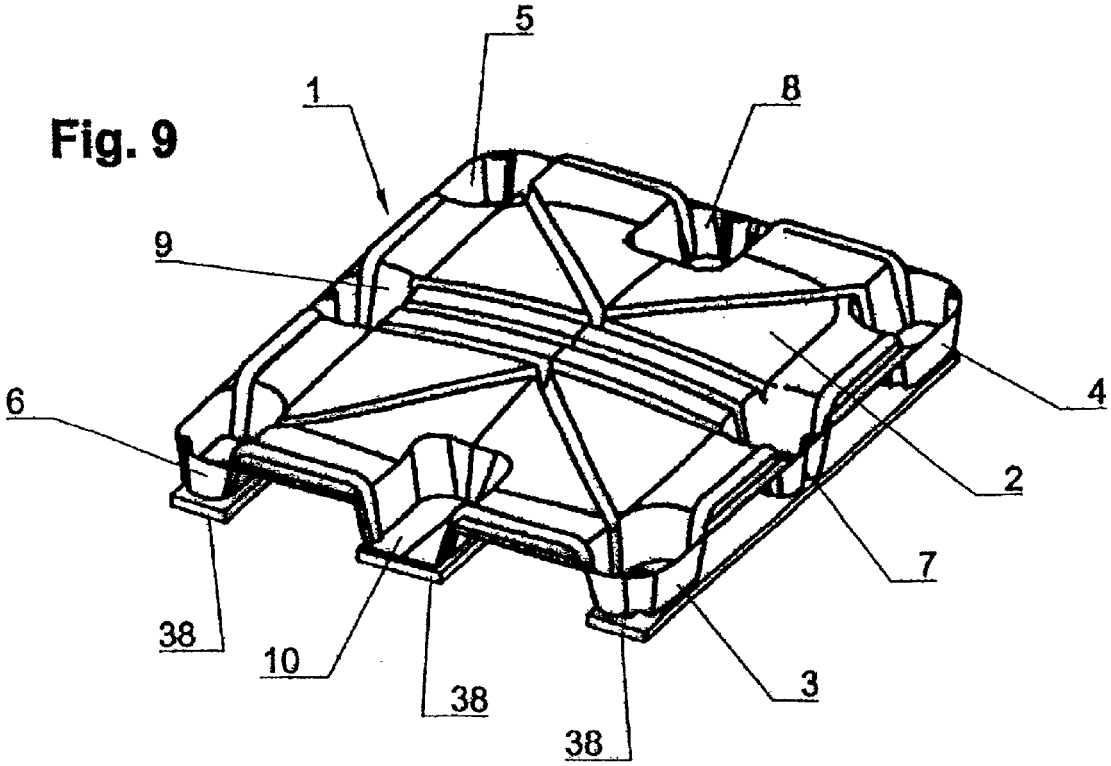
FIG. 9 is a perspective view of a pallet with skid rails.
Figure 10:
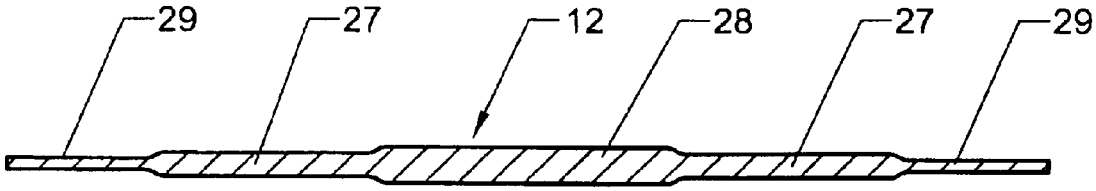
FIG. 10 is a sectional view of a base plate with different thicknesses.
Figure 11:
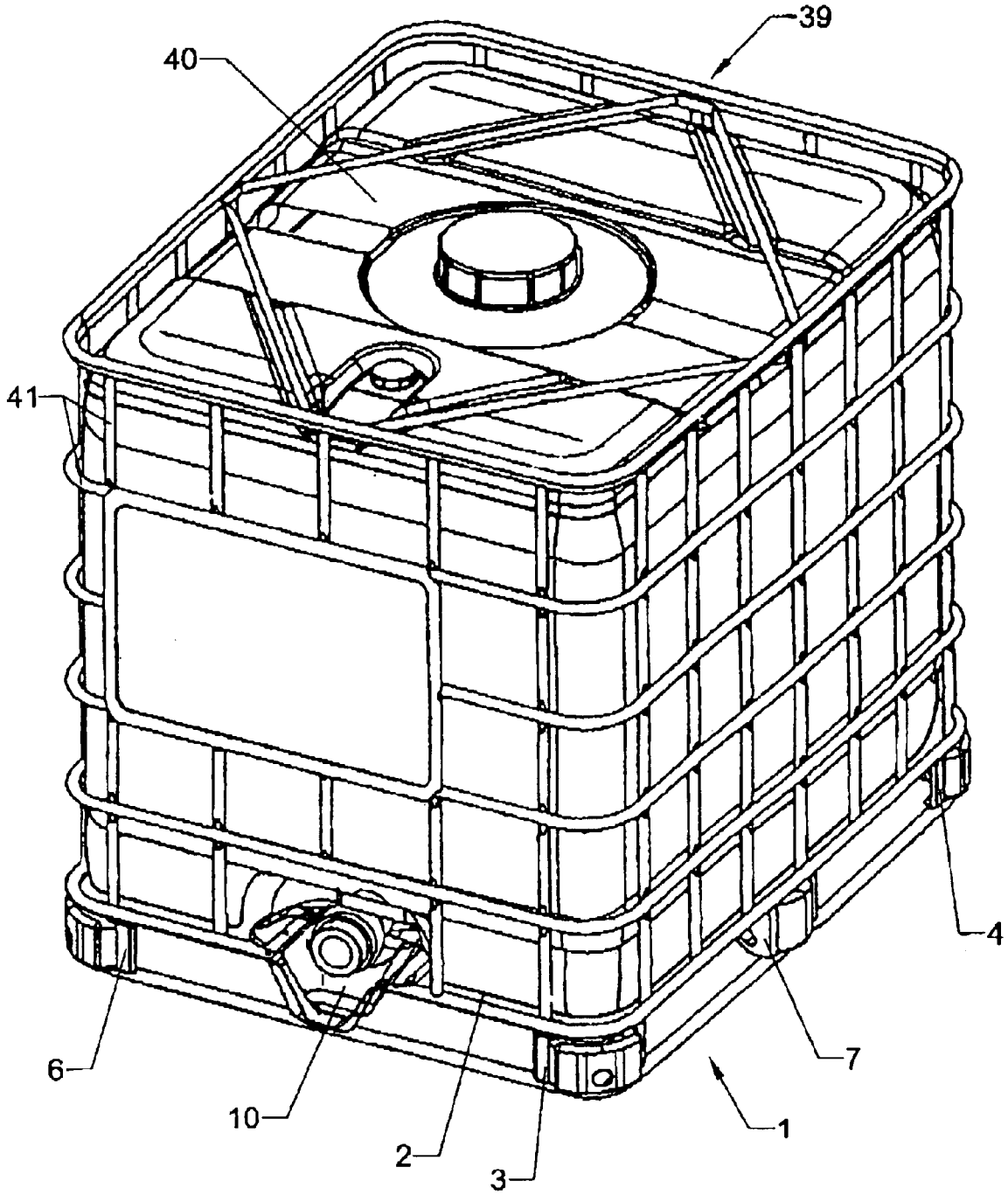
FIG. 11 is a perspective view of a base plate with a plastic container and lattice cladding.

In the pallet 1 illustrated in FIG. 9, skid rails 38 of metal, synthetic material or wood are attached to the legs 3 to 10.

The pallet 1 with an upwardly arched base plate 2 is preferably used as an underframe for pallet containers 39 for transporting and storing liquids with an inner container 40 of synthetic material placed on the base plate and with an outer cladding 41 of a lattice-work structure or sheet metal material attached to the base plate and the legs, wherein the bottom of the inner container, constructed as a bottom for draining the liquid for completely emptying the pallet container, is adapted to the curvature of the base plate of the pallet.

Moreover, the pallet 1 can also be used with a flat base plate 2 as a transport and storage pallet for goods of various types.

While specific embodiments of the invention have been shown and described in detail to illustrate the inventive principles, it will be understood that the invention may be embodied otherwise without departing from such principles.

I claim:

1. A Pallet, comprising: a one-piece steel plate that forms a metal cantilever base plate and metal feet as an underframe for pallet containers for transporting and storing liquids; a plastic inner container standing on the base plate; and a lattice-work or sheet material cladding secured to the base plate, the feet including one of open, partially closed and completely closed corner and center feet, and the steel plate having plate portions which are adapted to different stressed regions of the base plate and which have at least one of differing sheet thickness and differing material composition to achieve different mechanical strength properties.

* * * * *